United States Patent [19]

Porcher

[11] Patent Number: 4,702,022

[45] Date of Patent: Oct. 27, 1987

[54] SKI BOOT

[76] Inventor: Pierre O. Porcher, 10 rue du docteur Lancereaux, 75008 Paris, France

[21] Appl. No.: 918,259

[22] Filed: Oct. 14, 1986

[30] Foreign Application Priority Data

Oct. 11, 1985 [FR] France ..... 85 15085

[51] Int. Cl.[4] ..... A43B 5/04

[52] U.S. Cl. ..... 36/119; 36/71; 36/93

[58] Field of Search ..... 36/117–121, 36/71, 93, 3 R

[56] References Cited

U.S. PATENT DOCUMENTS 3,685,176 8/1972 Rudy .
4,420,893 12/1983 Stephan ..... 36/117 X

FOREIGN PATENT DOCUMENTS 0040189 11/1981 European Pat. Off. ..... 36/117
0155908 9/1985 European Pat. Off. ..... 36/117
1901606 8/1970 Fed. Rep. of Germany ..... 36/119
2321817 11/1973 Fed. Rep. of Germany ..... 36/3 R
8117283 6/1981 Fed. Rep. of Germany .
3310812 9/1984 Fed. Rep. of Germany ..... 36/117

*Primary Examiner*—James Kee Chi
*Attorney, Agent, or Firm*—Cushman, Darby & Cushman

[57] ABSTRACT

The invention relates to a ski boot in which an inner boot comprises two casing portions (1 and 2) which are clamped together by reduced pressure created in a vacuum chamber which includes bellows-like folds (*6a* and *6b*) of a side connection between a rear tongue portion (2) of the casing and a shin-covering portion (**1*b***) thereof.

10 Claims, 8 Drawing Figures

SKI BOOT

The present invention relates to a ski boot in which the boot is clamped to the foot by a vacuum system.

BACKGROUND OF THE INVENTION

Numerous types of ski boot already exist, and some of them are constituted by an outer shell having a sole which includes front and back rims for fixing to a ski, with the shell being made of a semi-rigid material capable of being deformed by mechanical clamping mechanisms in order to reduce its inside volume and thus clamp onto a deformable inner boot which receives the foot.

There is continuing research into reducing the number of operations that need to be performed in order to clamp together a foot and a ski boot. In some recent ski boots, the foot is clamped in the inner boot by pressing a rear portion of the boot upper against the leg and by locking said rear portion in position. Locking may be provided by a single mechanical device which is operated manually.

Ski boots also exist having one or more inflatable pneumatic cushions in connection with the atmosphere. The inflatable cushions have the advantage of spreading forces evenly over the foot, thereby avoiding force concentrations over regions that become tender, but they suffer from the disadvantage of requiring some other mechanical system to clamp the boot against the resilient force proved by the cushions.

The present invention seeks to provide a novel solution to closing a ski boot.

SUMMARY OF THE INVENTION

The present invention provides a ski boot comprising an outer shell suitable for receiving an inner boot and fitted with means for attachment to a ski and to an inner boot, said inner boot comprising:

a substantially rigid casing comprising first and second portions which are hinged to each other, the first portion comprising a sole and a housing for receiving the front of the foot, which housing is extended upwardly by a shin-covering section, the second portion of the substantially rigid housing constituting a tongue which is connected to the rear of the first portion in the vicinity of the heel and which is suitable for rocking towards said shin-covering section;

said tongue and said shin-covering section being interconnected by flexible double walls extending a vacuum chamber provided in the thickness of one of said inner boot portions, said double walls forming respective bellows-like folds in said vacuum chamber when said inner boot portions are moved towards each other, thereby penetrating as further into said vacuum chamber with increasing vacuum, and thus serving to hold said boot portions close to each other, and constituting, in the absence of a vacuum, a connection between said portions of sufficient length to enable them to be moved far enough apart to allow a foot to be inserted into the inner boot.

The vacuum chamber is provided with a manual pumping mechanism accessible from outside the casing. The vacuum chamber is preferably provided in the shin-covering section of the casing, but the pumping mechanism may be provided either directly on said shin-covering section or else on the outside wall of the rear tongue section which also includes a chamber capable of communicating with said vacuum chamber via other zones of the inner boot.

Finally the pumping mechanism may be connected to an inflatable pneumatic cushion situated near the top of said tongue in order to receive the air extracted from said vacuum chamber. A direct communication channel may also be provided between said vacuum chamber and said cushion and be provided by a normally closed valve so that opening said valve allows air to return from the cushion back into the vacuum chamber.

BRIEF DESCRIPTION OF THE DRAWINGS

Embodiments of the invention are described by way of example with reference to the accompanying drawings, in which.

MORE DETAILED DESCRIPTION

Figure 1:
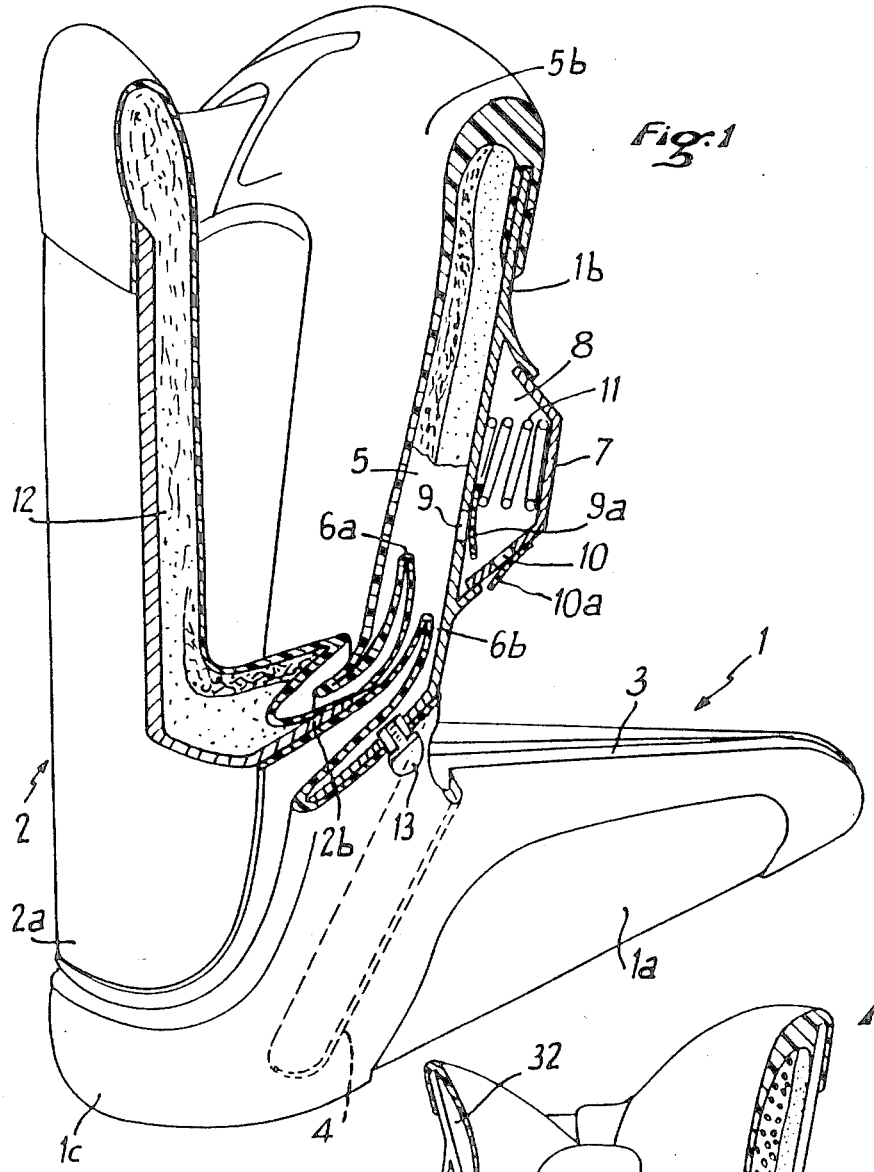
FIG. 1 is a partially cutaway diagrammatic perspective view of a first inner boot in accordance with the invention.

With reference to the figures, and in particular to FIG. 1, it can be seen that an inner boot in accordance with the invention comprises a two-part casing having portions 1 and 2. The portion 1 comprises a section **1*a* which receives the foot and is provided with a top longitudinal groove 3, and a rising section 1*b* for covering the front of the shin. The sections 1*a* and 1*b* of the first portion 1 of the casing are interconnected by a section 1*c* which surrounds the heel. A lateral slot 4 allows the rising section 1*b* to rock to a certain extent relative to the foot-receiving section 1*a*, which section 1*a*** also provides the entire sole of the inner boot.

The portion 2 of the casing constitutes a rear tongue for covering the rear of the leg, and it is hinged at its bottom end **2*a* to the heel section 1*c* of the portion 1** of the casing. The hinge means are not described in detail, but they may be constituted in conventional manner by any suitable kind of flexible cloth or other flexible link.

The rising section **1*b* of the casing includes a vacuum chamber 5 whose side walls are made of a flexible and deformable material in order to constitute (as shown) folds 6*a* and 6*b* which are connected to the side edges 2*b* of the rear tongue 2 and which return towards the rising section 1*b*. The front wall of the rising section includes a pump mechanism shown diagrammatically in FIG. 1 as a deformable wall 7 defining a variable volume chamber 8. This variable volume chamber is in communication firstly via an orifice 9 having a non-return valve 9*a* with the vacuum chamber 5, and secondly via an orifice 10 having a non-return valve 10*a* with the outside atmosphere. It will be understood that pressing against the wall 7 reduces the volume of the chamber 8 and expels the air contained therein outwardly through the orifice 10. When the wall is released, a spring 11 returns the volume of the chamber 8 to its initial state by sucking out the air contained in the vacuum chamber 5 via the orifice 9. The pressure in the chamber 5 is thus reduced, thereby forcing the folds to penetrate further and further into the vacuum chamber 5 and thus applying a force on the rims 2***b* of the tongue 2 drawing them towards the rising section 1*b*.

Cellular or spongy filler material with intercommunicating cells may be provided in the vacuum chamber 5, provided it is suitably shaped to leave room for the moving folds. This material could serve as a support for the inside wall 5*b* of the vacuum chamber.

In another embodiment, not shown, the vacuum chamber may include an inside wall 5*b* which is rigid and which is padded on the inside surface of the boot so as to be comfortable for the user. It should be observed that the casing of the inner boot is padded on the inside in this way for example there is padding 12 on the inside face of the tongue part 2.

Finally FIG. 1 shows a manually-operable relief valve 13 for providing communication between the vacuum chamber 5 and the atmosphere in order to inflate the vacuum chamber and open the boot.

Figure 2:
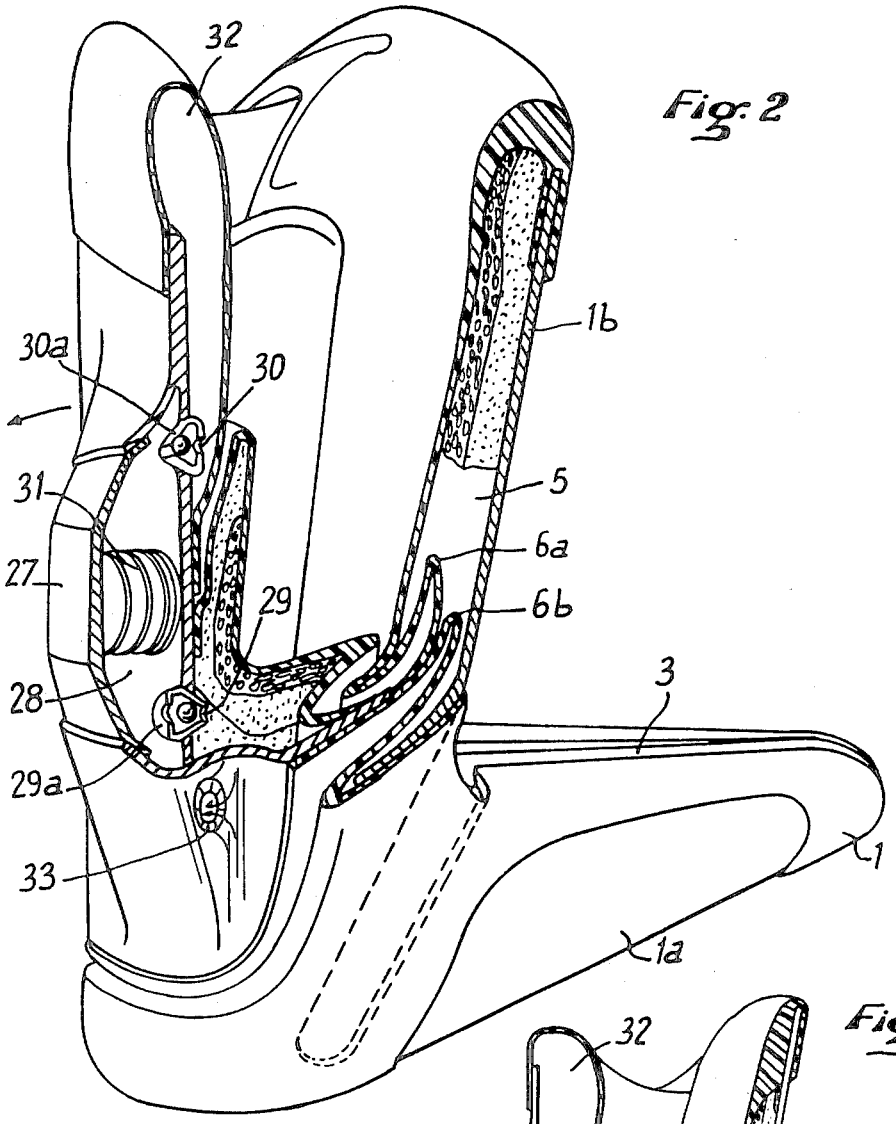
FIG. 2 is a view similar to FIG. 1 but showing a second and preferred inner boot in accordance with the invention.

In the variant shown in FIG. 2, the pumping mechanism is fixed to the rear tongue portion 2. In this figure, items of the pumping mechanism which are equivalent to those shown in FIG. 1 have the same reference numerals plus twenty. The air connection between the pump chamber 28 and the vacuum chamber 5 via the non-return valve 29*a* is provided by the entire inside lining of the inner boot which constitutes a closed chamber and which may be entirely at low pressure. The lining material is chosen with this in mind so that the air can be removed therefrom without causing the inside wall of the envelope in which it is contained to collapse.

It may be observed that the non-return valve 30*a* (which corresponds to the valve 10*a* in FIG. 1) opens out in this case into a sealed inflatable or pneumatic cushion 32 so that the air which is extracted from the vacuum chamber 5 is then transferred into the inflatable cushion 32. This closed-circuit arrangement ensures that the qualities and especially the hygrometric qualities of the air contained in or extracted from the vacuum chamber are retained at a constant value.

The vacuum chamber 5 is then reinflated by operating a normally closed manual valve 33 which provides a direct link between the inflatable cushion 32 and the chamber 5.

Figure 3B:
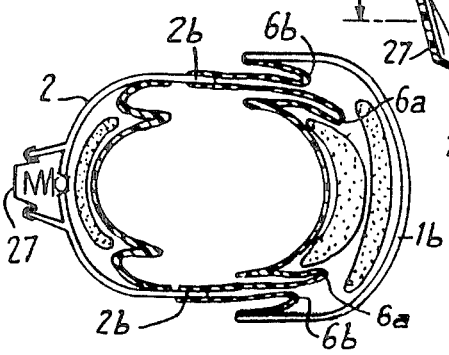
FIGS. 3A and 3B are a horizontal section and a vertical section respectively through the FIG. 2 inner boot in the open position.
Figure 3A:
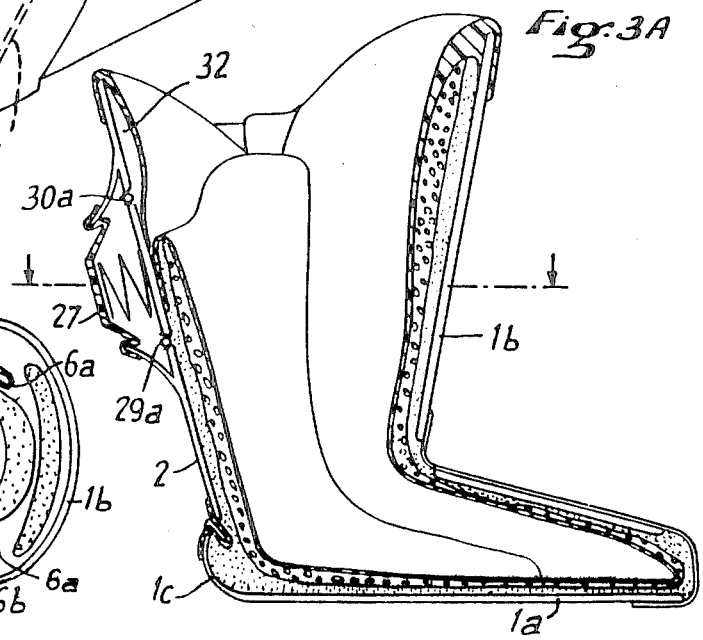

FIGS. 3A and 3B show the various component parts of the inner boot shown in FIG. 2. In the figures the inner boot is shown in its open position. FIG. 3A shows that communication between the pumping device and the vacuum chamber takes place through the entire lining of open-cell spongy material disposed inside the casing, and in particular through sole portion thereof. In FIG. 3B it can be seen that the flexible walls of the vacuum chamber constituting the folds 6*a* and 6*b* allow the tongue part 2 to be moved backwards away from the rising shin portion 1*b*. However, it may be observed that the folds 6*a* and 6*b* are not fully extended, thereby ensuring that the beginning of a fold is ready in place when the tongue part is moved forwards towards the shin portion.

Figure 4B:
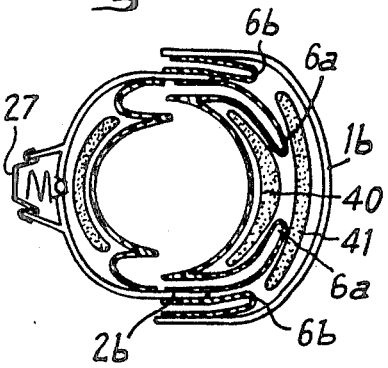
FIGS. 4A and 4B are similar to FIGS. 3A and 3B but show the inner boot in its closed position.
Figure 4A:
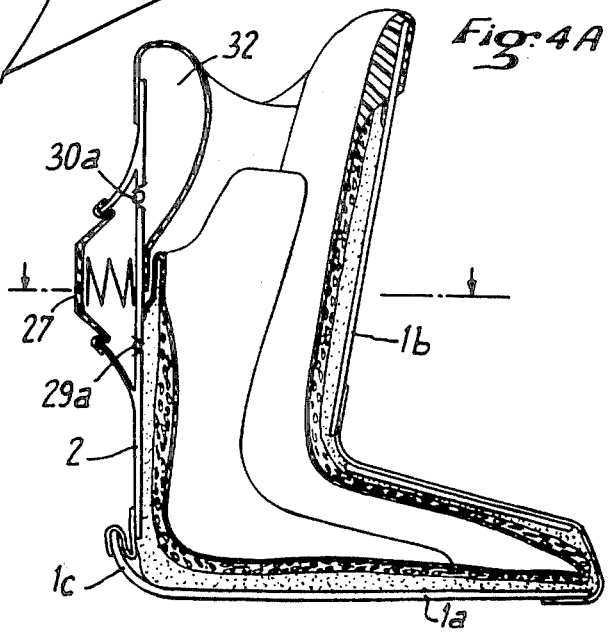

After inserting a foot into the inner boot, a user begins to close it manually by moving the tongue towards the shin section 1*b*. The boot then takes up the configuration shown in FIG. 4A and 4B, with the folds 6*a* and 6*b* penetrating deeply into the vacuum chamber 5, and in particular into the empty spaces therein provided between the portions 40 and 41 of spongy lining which it includes. When the pumping mechanism is actuated, the pressure throughout the inside lining of the boot is reduced, thereby tending to force the folds so that they penetrate further into the chamber 5 and to lock said penetrating folds against various walls provided for that purpose in the vacuum chamber. Simultaneously, the inflatable cushion 32 is inflated.

Figure 5:
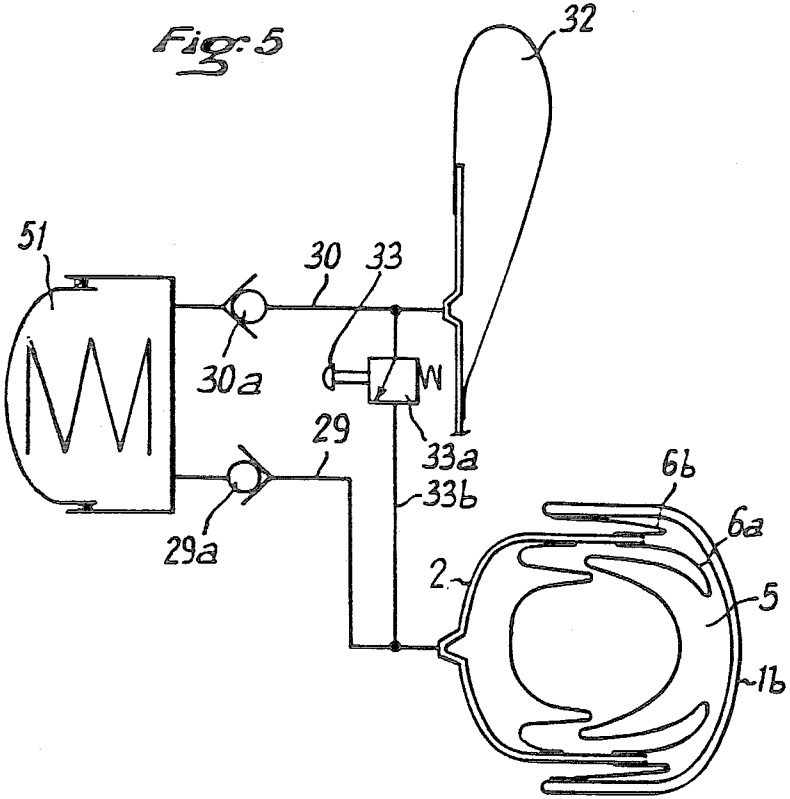
FIG. 5 is a pneumatic diagram of a boot in accordance with the invention.

FIG. 5 shows the inflatable cushion 32, the tongue 2, the shin-covering section 1*b* and the vacuum chamber 5. The pumping mechanism is symbolized by the piston-and-cylinder assembly 51 which serves to transfer the air contained in the vacuum chamber 5 into the inflatable cushion 32 via non-return valves 29*a* and 30*a*. It can be seen that the pushbutton 33 actuates a valve 33*a* placed on a direct link 33*b* between the inflatable cushion 32 and the chamber 5.

Figure 6:
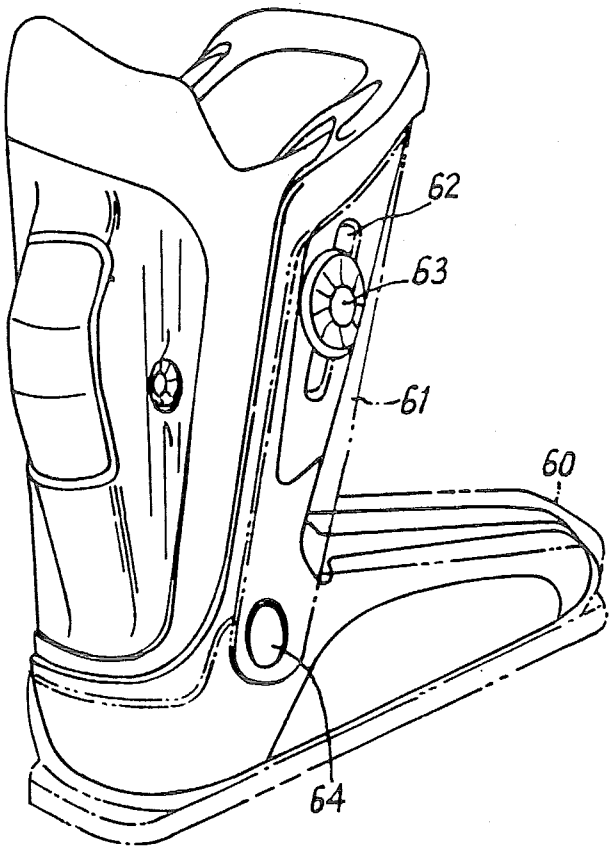
FIG. 6 is a diagram showing an inner boot in accordance with the invention received in an outer shell, thereby constituting an entire ski boot.

FIG. 6 shows how the inner boot in accordance with the invention may be inserted in a shell 60 having a bottom portion which completely surrounds the bottom portion of the inner boot casing, said bottom portion being upwardly extended by a side rod 61. The rod 61 may be fixed to the side portion of the shin-covering section 1b by means of a screw-and-nut system passing through a slot 62 provided in the rod 61 and positioned so as to enable the final slope given to the shin-covering section of the inner boot to be adjusted, and then locked in place. The screw-and-nut system includes a manually-operable knob 63 for tightening and loosening. Finally, it may be observed that the rod 61 which matches a substantially identical rod on the inside of the boot is hinged to the bottom portion of the shell 60 about an axis 64.

The invention is applicable to sportswear.

I claim:

1. A ski boot comprising an outer shell suitable for receiving an inner boot and fitted with means for attachment to a ski and to an inner boot, said inner boot comprising:

a substantially rigid casing comprising first and second portions which are hinged to each other, the first portion comprising a sole and a housing for receiving the front of the foot, which housing is extended upwardly by a shin-covering section, the second portion of the substantially rigid housing constituting a tongue which is connected to the rear of the first portion in the vicinity of the heel and which is suitable for rocking towards said shin-covering section;

said tongue and said shin-covering section being interconnected by flexible double walls extending a vacuum chamber provided in the thickness of one of said inner boot portions, said double walls forming respective bellows-like folds in said vacuum chamber when said inner boot portions are moved towards each other, thereby penetrating farther into said vacuum chamber with increasing vacuum, and thus serving to hold said boot portions close to each other, and constituting, in the absence of a vacuum, a connection between said portions of sufficient length to enable them to be moved far enough apart to allow a foot to be inserted into the inner boot.

2. A ski boot according to claim 1, wherein the vacuum chamber is provided with a manual pumping mechanism accessible from outside the inner boot casing.

3. A ski boot according to claim 1, wherein the vacuum chamber is provided in the shin-covering section of the first portion of the inner boot casing.

4. A ski boot according to claim 1, wherein the vaouum ohamber communicates with a chamber provided in the tongue by means of an inner lining of the inner boot, said lining being filled with a spongy material having inter-communicating cells.

5. A ski boot according to claim 4, wherein the vacuum chamber is provided with a manually-operated pumping mechanism accessible from outside the inner boot casing and wherein the outlet from said pumping device is connected to a deformable enclosure constituting an inflatable cushion looated near the top of the inner boot.

6. A ski boot according to claim 2, wherein the pumping mechanism comprises a deformable wall of a pump ohamber formed in the corresponding wall of the inner boot casing, a return spring acting on said deformable wall, with said pump chamber communicating with said vacuum chamber via an inlet channel fitted with a non-return valve for extracting air from the vacuum chamber when the deformable wall moves to increase the volume of the pump chamber, and communicating with an exhaust channel via a second non-return valve for exhausting air from the pump chamber when the deformable wall reduces the volume thereof.

7. A ski boot according to claim 6, wherein the vacuum chamber includes a normally closed connection with the outside air, and a manually operated valve for opening said connection.

8. A ski boot according to claim 6, wherein the outlet from the pumping device is connected to a deformable enclosure constituting an inflatable cushion, wherein said vacuum chamber has a normally-closed link to said inflatable cushion and wherein a manually operable valve is provided on said link for establishing communication therealong.

9. A ski boot according to claim 1, wherein the inner boot is connected to the outer shell by means of at least one side rod hinged at its bottom end to the shell and connected thereabove to the inner boot by means of a screw-and-nut system passing through an oblong slot in said rod.

10. An inner boot as defined in claim 1.

* * * * *